US007483643B2

(12) United States Patent
Kougami et al.

(10) Patent No.: US 7,483,643 B2
(45) Date of Patent: Jan. 27, 2009

(54) IMAGE FORMING APPARATUS AND MOISTURE FEEDING DEVICE PROVIDED THEREWITH

(75) Inventors: Masashi Kougami, Saitama (JP); Hirofumi Kayahara, Hachioji (JP); Hisao Satoh, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 196 days.

(21) Appl. No.: 11/480,416

(22) Filed: Jul. 5, 2006

(65) Prior Publication Data

US 2007/0048048 A1 Mar. 1, 2007

(30) Foreign Application Priority Data

Aug. 26, 2005 (JP) ..... 2005-245697
Apr. 27, 2006 (JP) ..... 2006-123185

(51) Int. Cl.
*G03G 15/00* (2006.01)
*G03G 21/20* (2006.01)
*G03G 21/00* (2006.01)

(52) U.S. Cl. ..... 399/21; 399/97; 399/124

(58) Field of Classification Search ..... 399/21, 399/97, 124
See application file for complete search history.

(56) References Cited

U.S. PATENT DOCUMENTS 5,678,123 A * 10/1997 Kim ..... 399/21
6,052,553 A * 4/2000 Acquaviva et al. ..... 399/406
6,253,046 B1 * 6/2001 Horrall et al. ..... 399/124

* cited by examiner

*Primary Examiner*—David M Gray
*Assistant Examiner*—Joseph S. Wong
(74) *Attorney, Agent, or Firm*—Finnegan, Henderson, Farabow, Garrett & Dunner, L.L.P.

(57) ABSTRACT

An image forming apparatus includes: a moisture feeding unit which supplies moisture to a sheet when the sheet passes through a nip portion of a pair of porous rollers, which has a lower roller absorbing water and an upper roller absorbing water in contact with the lower roller, and comprises a water supplying unit which supplies water to the pair of porous rollers, after the sheet onto which a toner image has been formed by and image forming unit passes through a fixing unit. A contact of a contact member in contact with each of a circumference surface of the upper roller and the lower roller is released when a sheet jam occurs.

4 Claims, 4 Drawing Sheets

IMAGE FORMING APPARATUS AND MOISTURE FEEDING DEVICE PROVIDED THEREWITH

This application is based on Japanese Patent Application Nos. 2005-245697 filed on Aug. 26, 2005, and 2006-123185 filed on Apr. 27, 2006, which are incorporated hereinto by reference.

BACKGROUND OF THE INVENTION

The present invention relates to an image forming apparatus and moisture feeding device having a moisture feeding unit for giving moisture to a sheet onto which an image is particularly fixed by a heat fixing unit.

In general, a toner image is fixed onto a sheet by forming an image onto the sheet by using fine powder toner, heating and pressing the toner image onto the sheet in an image forming apparatus for forming an image by an electrophotographic method.

Due to the heating process in a fixing unit, moisture evaporates from the sheet. However, since the sheet is exposed to the environment, the sheet absorbs the moisture. Consequently the moisture included in the sheet is gradually recovered. However, the recovery of the moisture is not uniform. The recovery of the moisture proceeds in different rates depending on the portion of the sheet. For example, when the sheets are placed in a condition that a plurality of sheets are bundled, the process of absorbing moisture in a peripheral portion of the sheet proceeds in a high rate, however the process of absorbing moisture in a center portion of the sheet proceeds in a low rate or hardly proceeds.

Accordingly, since the elongation percentage of the sheet is different depending on the portion of the sheet due to the differences of the moisture content, the sheet tents to be shaped in waves and curl.

Even though this phenomenon varies depending on the kind of sheet, this phenomenon tends to occur in a place where a plurality of sheets is placed. This phenomenon tends to occur with sheets placed in the ejection tray where sheets onto which an image has been formed are ejected and with sheets placed in a stacker for a binding process, particularly in an ejection tray configured by a stacker having large capacity.

Since due to the differences of moisture contents, the elongation percentage of the sheet is different depending on the portion of the sheet, a waving phenomenon occurs.

There is a case that a curl phenomenon occurs with a sheet due to that the sheet curves.

U.S. Pat. No. 5,264,899 (Patent Document 1) discloses a device for adding moisture to a sheet to prevent development of edge waves formed along with the sheet by adding water from a shaft center of a pair of humidifying rollers by using a pair of porous humidifying rollers for conveying sheets.

SUMMARY OF THE INVENTION

The present invention is as follows.

(1) An image forming apparatus comprises a moisture feeding unit which supplies moisture to a sheet when the sheet passes through a nip portion of a pair of porous rollers, which has a lower roller absorbing water and an upper roller absorbing water in contact with the lower roller, after the sheet onto which a toner image has been formed by an image forming unit passes through a fixing unit, and comprises a water supplying unit which supplies water to the pair of porous rollers, wherein a contact member in contact with each of a circumference surface of the upper roller and the lower roller is arranged to be released when sheet jam occurs.

(2) An image forming apparatus comprises a moisture feeding unit which supplies moisture to a sheet when the sheet passes through a nip portion of a pair of porous rollers, which has a lower roller absorbing water and an upper roller absorbing water in contact with the lower roller, after the sheet onto which a toner image has been formed by an image forming unit passes through a fixing unit, and comprises a water supplying unit which supplies water to the pair of porous rollers, wherein the pair of porous rollers and a pair of conveyance rollers provided at a place adjacent to downstream of the pair of porous rollers in a sheet conveyance direction are arranged to rotate for a predetermined time interval to eject a jammed sheet, when sheet jam occurs.

(3) A moisture feeding unit comprises a pair of porous rollers having a lower roller and an upper roller for absorbing water, and a water supplying unit for supplying water to the pair of porous rollers, thereby supplying moisture to a sheet through a nip portion of the pair of porous rollers, wherein a contact member in contact with a circumference surface of the upper roller or the lower roller is arranged to be released, when sheet jam occurs.

(4) A moisture feeding unit comprises a pair of porous rollers having a lower roller and an upper roller for absorbing water, the pair of porous rollers supplying moisture to a sheet through a nip portion thereof and a water supplying unit for supplying water to the pair of porous rollers, wherein the pair of porous rollers and a pair of conveyance rollers provided at a place adjacent to downstream of the pair of porous rollers in a sheet conveyance direction are arranged to rotate for a predetermined time interval to eject a jammed sheet, when sheet jam occurs.

DETAILED DESCRIPTION OF THE PREFERRED EMBODIMENT

Figure 1:
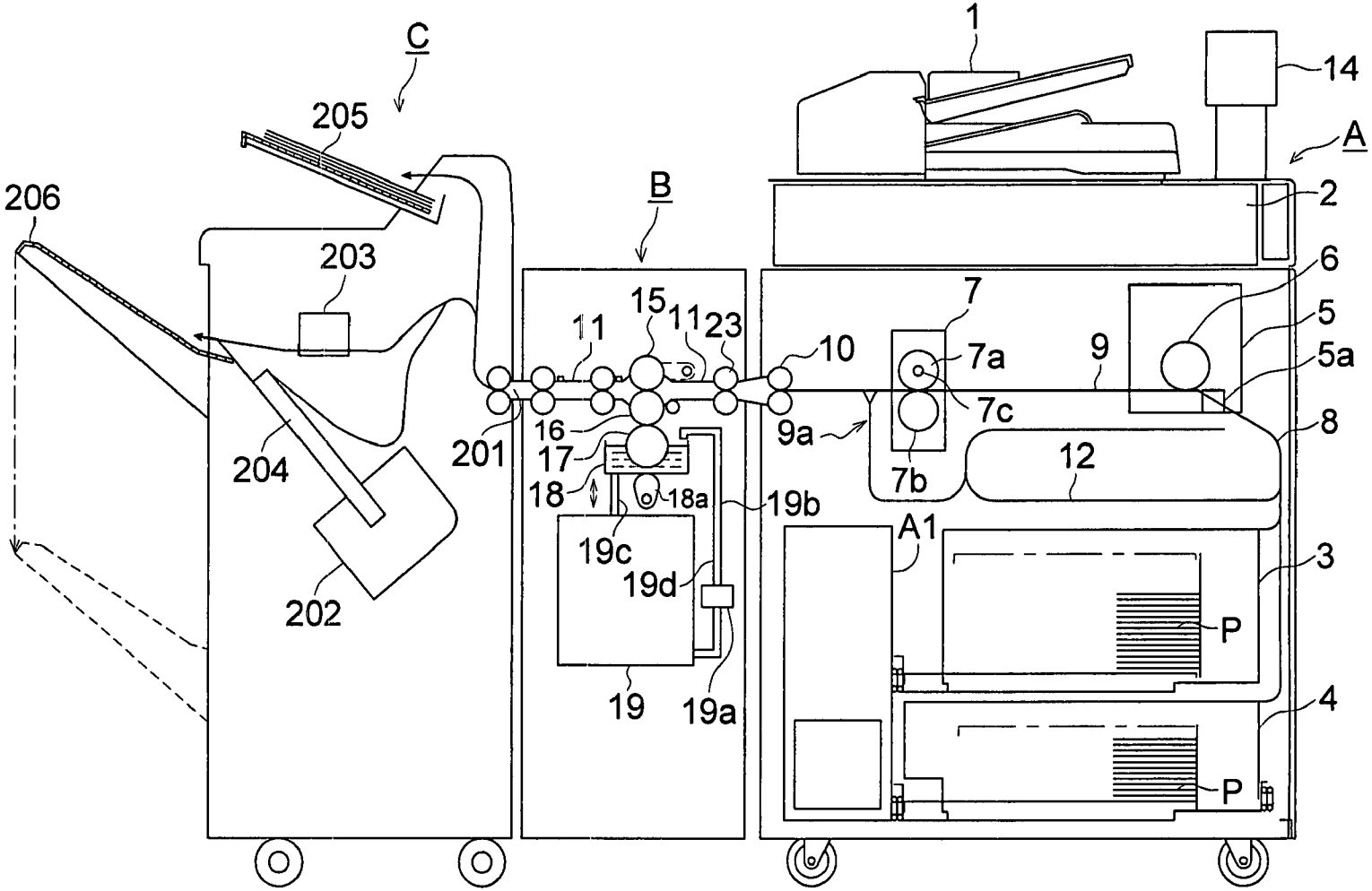
FIG. 1 is a schematic diagram illustrating an image forming apparatus of the embodiment of the present invention.

FIG. 1 is a schematic diagram illustrating an image forming apparatus of the embodiment of the present invention. The image forming apparatus is equipped with an image forming apparatus main body A, a moisture feeding device B having a moisture feeding unit 30 for feeding moisture to a copy paper and a finisher C. The image forming apparatus main body A of the embodiment of the present invention includes an automatic document feeder 1 and an image reading device 2 in the upper portion and a printer section in the lower portion of the image forming apparatus main body A.

In the printer section, numerals 3 and 4 denote a sheet storing section for storing a sheet P. An image forming section 5 forming a toner image onto a photosensitive material 6 by an electrophotographic process for conducting a charging process, an exposing process and a developing process against the photosensitive material 6, forms an image onto a sheet P.

A fixing unit 7 fixes the image formed on the photosensitive material 6 in the image forming section 5. The fixing unit 7 includes a heat roller 7*a* having a heat source 7*c* therein and a pressure roller 7*b*, which form a nip portion for conveying a sheet P. The fixing apparatus 7 fixes an image onto the sheet P by melting toner by heating and pressing the sheet P while conveying the copy paper P.

The sheet P is supplied from the sheet storing sections 3 and 4. After the sheet P pauses for a moment at a sheet feeding section 5*a* of an image forming section 5, an image is formed on the sheet and the sheet P on which the image is formed is ejected by a sheet ejection roller 10.

With regard to the conveyance path of the sheet, provided are a sheet feeding path 8 starting from the paper storing sections 3 and 4 to the image forming section 5, a conveyance path 9 staring from the image forming section 5 to an ejecting roller 10 via the fixing unit 7 and a reverse and conveyance path 12 for conducting reverse conveyance.

With regard to image forming modes, there are three modes, which are a one-sided sheet face down ejection mode, a one-sided sheet face up ejection mode and a two-sided sheet mode. In the one-sided sheet face down ejection mode, an image is formed on a surface of a sheet P and the sheet P is ejected by a pair of ejecting rollers 10 after a reverse process turns the sheet P up side down in a switchback conveyance path 9*a*.

In the one-sided sheet face up ejection mode, an image is formed on a surface of the sheet p and the sheet P conveyed in the conveyance path 9 is ejected by a pair of eject rollers 10 in the same aspect as it has been.

In the two-sided sheet mode, the sheet P on which an image is formed passes through the fixing unit 7, runs downward and proceeds to a reverse and conveyance path 12. The sheet P is fed again to the sheet feeding path 8 after being turned up side down.

The image forming section 5 forms a rear side image on the rear side surface of the sheet P, which has been fed again. The sheet P on which the rear surface image has been formed passes through the fixing unit 7. The sheet P is conveyed and ejected by the pair of ejecting rollers 10. Numeral 14 denotes an operation section by which various modes in the image forming apparatus main body A and output modes by using the finisher C can be set by the operation conducted on the operation section 14.

The sheet P ejected from the image forming apparatus main body A is conveyed to the finisher C through a moisture feeding unit B.

The finisher C includes a staple processing section 202, a shift processing section 203 and intermediate stacker 204. The finisher C conducts either a staple processing or a shift processing, then ejects the sheet P out to an ascending and descending ejection tray 206.

The finisher C further includes a fixed ejection tray 205. The sheet P is ejected onto the fixed ejection tray 205 in the case of a small quantity image-forming job.

The staple processing section 202 conducts a stapling process after stacking a predetermined number of sheets on the intermediate stacker 204. A bundle of processed sheet P is ejected onto the ascending and descending ejection tray 206 by lifting up the stacker 204.

In the case of the small quantity image forming job, the sheet P inserted from an introduction opening 201 is ejected onto a fixed ejection tray 205.

Even in the case of the mode in which finishing processes such as a stapling process and a shifting process are not conducted, when conducting a large quantity of image formation, the sheet P is ejected onto the ascending and descending ejection tray 206.

A1 denotes a controller, which conducts image forming process control, fixing temperature control, sheet conveyance sequence control of the entire apparatus.

A sheet conveyance mechanism adjacent to the pair of porous rollers of the present invention and pressure of a pressing member in contact with the lower roller and a pressure releasing mechanism will be described below.

Figure 2:
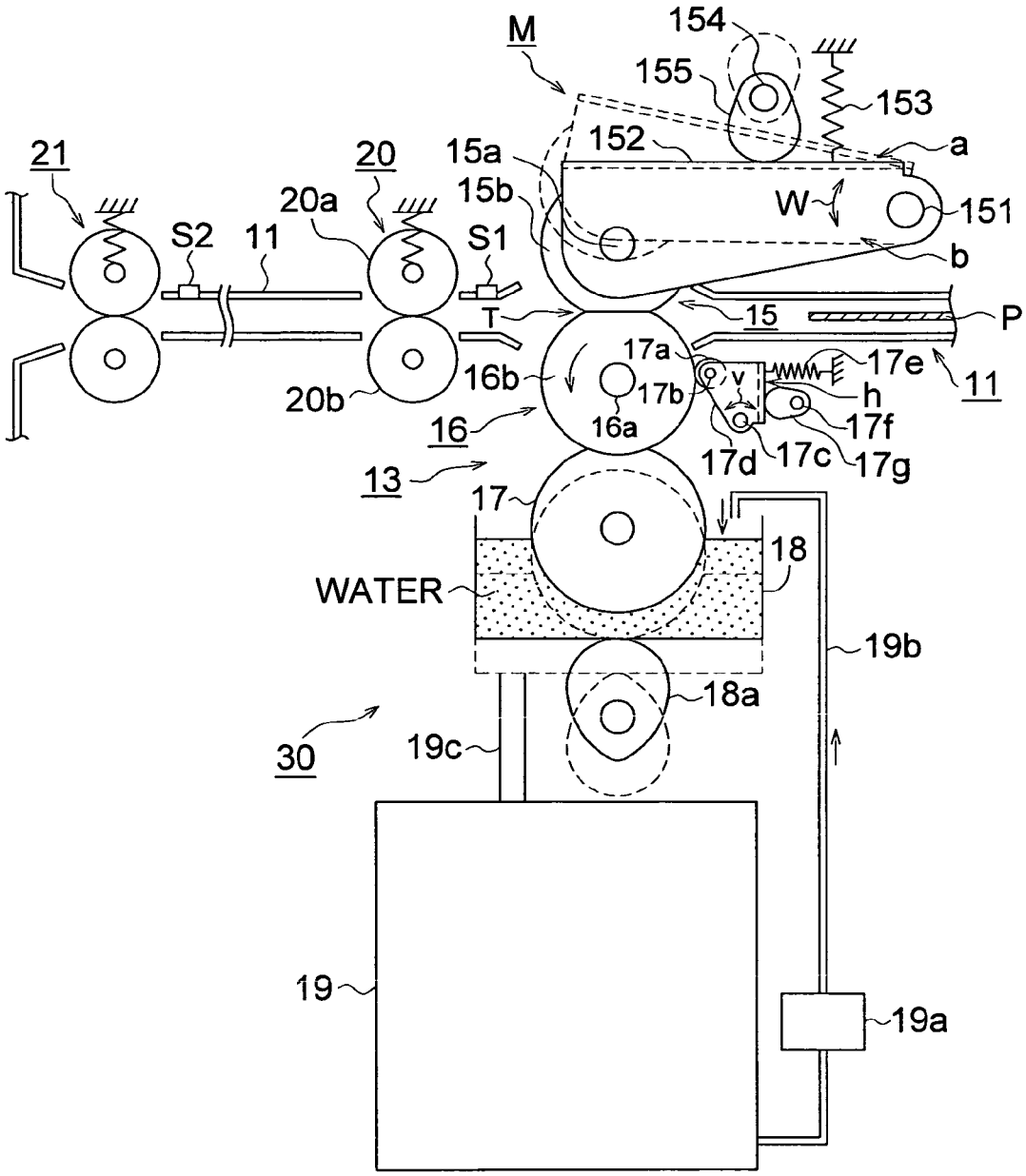
FIG. 2 is an enlarged view illustrating a pressure applying mechanism of a pair of humidifying rollers of a water supply unit B illustrated in FIG. 1.

FIG. 2 is an enlarged view illustrating a pressure applying mechanism of a pair of humidifying rollers of a water supply unit B illustrated in FIG. 1.

Figure 3:
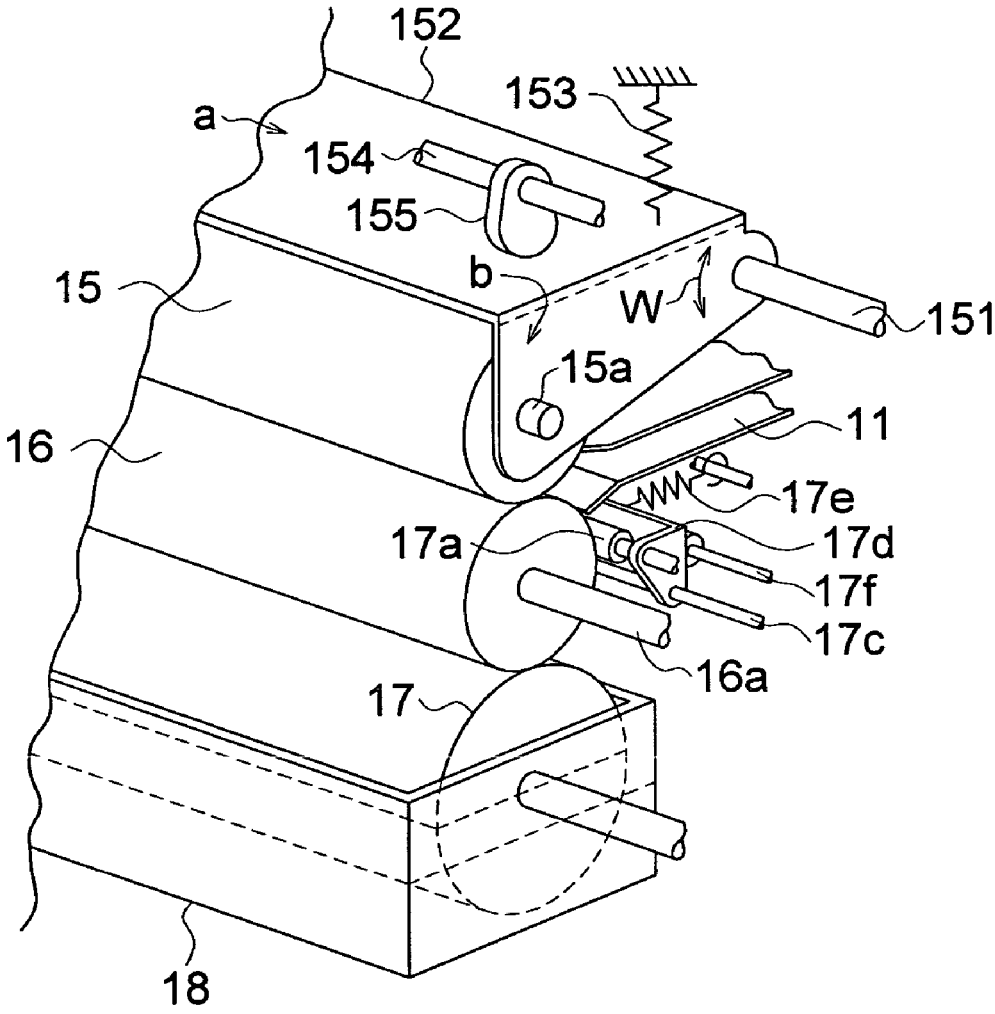
FIG. 3 is a perspective view illustrating a portion adjacent to one edge of the pair of humidifying rollers illustrated in FIG. 2.

FIG. 3 is a perspective view illustrating a portion adjacent to one edge of the pair of humidifying rollers illustrated in FIG. 2.

In FIGS. 1-3, numeral 11 denotes a sheet conveyance path in the moisture feeding unit B. A pair of humidifying rollers 13 configured by the upper roller 15 and the lower roller 16 as a pair of porous rollers is provided on the sheet conveyance path 11.

The upper roller 15 and the lower roller 16 are both structured by forming porous layers 15*b* and 16*b* of porous polyurethane rubber on shaft centers 15*a* and 16*b* configured by metal and a rigid member such as rigid resin. The both porous layers 15*b* and 16*b* feed moisture to the sheet P when water is fed onto the surface of the porous layers 15*b* and 16*b* and form a porous surface to feed moisture to the sheet P. A pressure applying mechanism M presses down the upper roller 15 to a predetermined position and forms a nip section T when the upper roller 15 comes into contact with the lower roller 16 and is pressed against the lower roller 16. The detailed explanation of the pressure applying mechanism M will be described later.

Since when starting (a power switch of the apparatus is turned on), it is necessary to swiftly receive water, a water feeding container 18 having a water feeding roller 17 structured by porous urethane rubber is pushed up to the most highest position (a solid line illustrated in FIG. 2) by rotating a cum mechanism 18*a* along with a guide (not shown). (When the power switch of the apparatus is in an OFF state, the cum mechanism pushes down the water feeding container 18 to the lowest position (dotted lines illustrated in FIG. 2) so that the water feeding roller 17 comes off from the humidifying roller 16.) The water feeding roller 17 rotates by obtaining driving power from a driving power source (not shown), comes into contact with the lower roller 16, and feeds water to the sheet P. The power source (not shown) rotates the shaft center 16*a* so that the lower roller 16 rotates in the arrow direction.

A water supplying unit 30 is constituted by a water supplying roller 17, a water supplying container 18, a water storing tank 19, a pump 19*a*, a feeding pipe 19*b* and a drain-pipe 19*c*. A moisture feeding unit is constituted by a water supplying unit 30 and a pair of humidifying rollers 13.

Numeral 17*a* denotes a regulation member structured by a metal shaped in a round bar or a rigid member structured by a hard resin, the regulation member regulating the water content of the humidifying roller 16. A supporting frame 17*d* arranged to rotate in the V-arrowed direction centering on a supporting shaft 17*c* supports the regulation member 17*a* at the both ends of a rotation shaft 17*b*. A spring 17*e*, one end of which is held by a fixed frame (not shown) is fixed onto the rear surface h. An off-center cum 17*g* unified with a rotation shaft 17*g* pushes the supporting frame 17*d* against the tension force of the spring 17*e*. Namely, the regulation member 17*a* varies the degree of pressure to the lower roller 16 depending on the rotational position of the off-center cum 17*g* and squeezes water included in the porous layer 16*b* by deforming the porous layer 16*b*. Consequently, the water content of the lower roller 16 varies, the amount of water supplying to the sheet P is regulated, the sheet P is appropriately humidified and the stickiness of the sheet P due to the over moisture supplied to the sheet P can be prevented. Namely, it becomes possible to appropriately regulate the humidity or moisture of the sheet P by adjusting the contact pressure of the regulation member 17*a* to the humidifying roller 16. Here, the regulation member 17*a* may rotate according to the humidifying roller 16 or may give only pressure to the humidifying roller 16, but not rotate.

FIG. 2 illustrates a state that the off-center cum 17*g* presses the regulation member 17*a* with the highest pressure. However, when rotating the off-center cum 17*g* 180°, the regulation member 17*a* comes off from the lower roller 16.

Next, a pressing mechanism of the present invention will be described below.

Side surfaces b located in both sides of a supporting frame 152, which rotates in the arrow W direction centering on a fulcrum shaft 151 held by a frame member (not shown) hold a rotational shaft 15*a* unified with an upper roller 15. A hook of one end of a spring 153 is hooked with the upper surface of a supporting frame 152 and the other end of the spring 153 is hooked with a pair of frames (not shown). The upper surface of the supporting frame 152 is in contact with an off-center cum 155 being unified with a rotation shaft 154 capable of rotating by obtaining driving power from a driving power source (not shown). As shown in FIG. 2, the upper roller 15 is arranged to move from the lowest position (a solid line as illustrated in FIG. 2) to the highest position (a doted line as illustrated in FIG. 2) in which the upper roller 15 comes off from the lower roller 16. It is also possible to adjust the position of the upper roller 15 to the degree that the upper roller 15 lightly presses the lower roller 16 from the state of the lowest position (the highest pressure state) by rotating the off-center cum 155. It becomes possible to adjust the amount of moisture feeding to the sheet P by varying the nip width of the upper and lower rollers in response to the degree of waves and curl of the sheet P by configuring the moisture feeding device as described above.

As described above, since the sheet P to which the upper and lower rollers of the pair of humidifying rollers have fed moisture becomes weak in hardness and the absorbing power of the sheet P becomes large, there is a problem that the sheet P tends to wind around the upper and lower rollers and conveyance jam tends to occur adjacent the upper and lower rollers.

An object of the present invention is to suppress the damage caused by the problem described above.

A mechanical configuration of the present invention will be described below.

Figure 4:
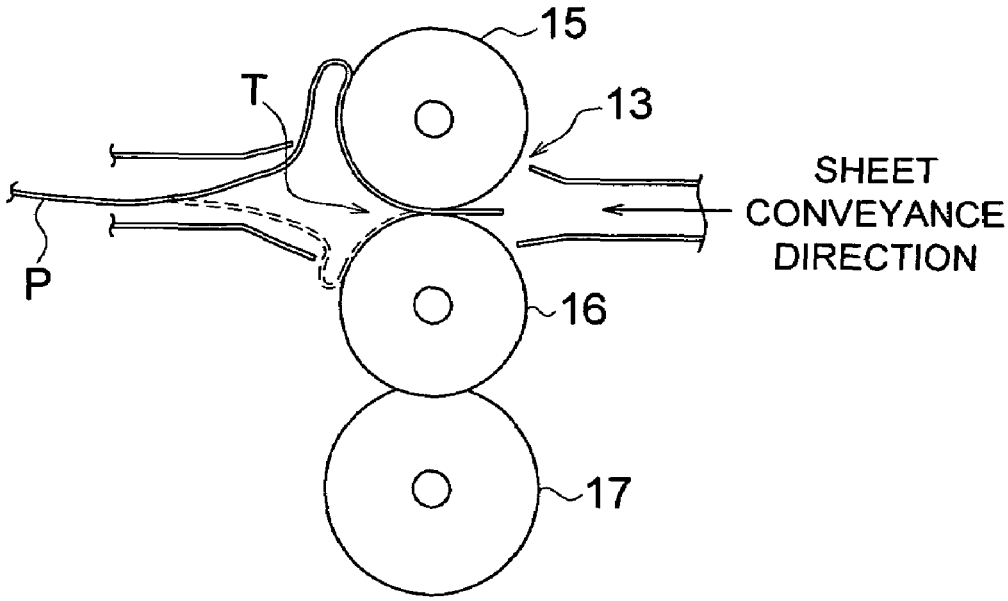
FIGS. 4(*a*) and 4(*b*) illustrate an example of a sheet jam occurred adjacent to the nip portion of a pair of humidifying rollers.
Figure 4:
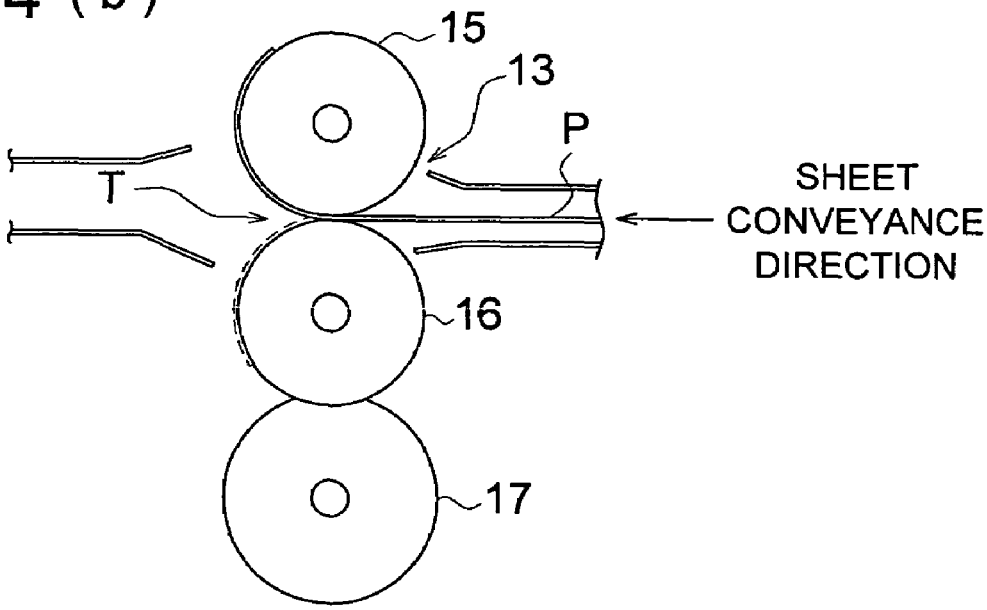

In FIG. 2, a pair of conveyance rollers 20, which rotates at the same timing as the lower roller 16, the pair of conveyance roller being driven by the same driving source applied to the lower roller 16 is provided adjacent to the downstream of the nip portion T of the upper and lower rollers 15 and 16. The pair of conveyance rollers 20 includes a pressure roller 20*a* and a driving roller 20*b*. Further, sheet detectors S1 and S2 being reflection type sensors for detecting the passage of the sheet P are provided between the pair of conveyance rollers 20 and the pair of humidifying rollers 13 (the upstream of the conveyance rollers 20 in the sheet conveyance direction), which is positioned at a predetermined distance from the center of the nip portion T, and at a position adjacent to the upstream side of the pair of ejection rollers 21 (the downstream side of the conveyance rollers 20 in the sheet conveyance direction) and at a predetermined distance from the center of the nip portion T. In the case that the front end of the sheet to which water has been fed reaches to the position where the reflection type sensor Si is located and the sensor output turns ON, then the sheet P is interposed by the pair of conveyance rollers 20, however the output of the sensor S1 does not turn to OFF, namely when the rear edge of the sheet p does not reach the reflection type sensor S1, the controller A1 determines that the rear edge of the sheet P has wound around the upper roller 15 or the lower roller 16 as illustrated in FIG. 4(*a*), winding type jam occurs, or jam occurs in the upstream of the reflection type sensor S1 in the conveyance direction. In this case, the pair of humidifying rollers 13, the pair of conveyance rollers 20 and the pair of ejection rollers 21 are forcefully rotated to eject the jammed sheet. According to this process, it becomes possible to swiftly remove the jammed sheet. Further, in the case that the front end of the sheet to which water has been fed reaches to the position where the reflection type sensor S2 is located and the sensor output turns ON, however the output of the sensor S1 does not turn to OFF within a predetermined time interval, the controller A1 determines that the rear edge of the sheet P has wound around the upper roller 15 or the lower roller 16 as illustrated in FIG. 4(*a*), winding type jam occurs, or jam occurs in the upstream of the reflection type sensor S2 in the conveyance direction. In this case, the pair of humidifying rollers 13, the pair of conveyance rollers 20 and the pair of ejection rollers 21 are also forcefully rotated to eject the jammed sheet as described above.

Further, in the case that the sheet is detected by a sensor (not shown) provide in the upstream side than the reflection type sensor S1 in the conveyance direction of the sheet (for example, an ejection sheet sensor provided adjacent the ejection rollers 10 in the image forming apparatus main body B), however the output of the sensor S1 does not turn ON after a predetermined time interval, the controller A1 determines that the front edge of the sheet P has wound around the upper roller 15 or the lower roller 16 as illustrated in FIG. 4(*b*), winding type jam occurs, or jam occurs in the upstream of the pair of humidifying rollers 13 in the conveyance direction of the sheet. In this case, put away and evacuate the upper roller 15 being a contact member contacting the lower roller 16, the regulation member 17*a* and the water feeding roller 17 from the lower roller 16 and turns off the apparatus. Based on this operation described above, it becomes possible to remove the jammed sheet and suppress the damage caused by the winding jam.

A program of a sheet conveyance sequence utilizing a reflection type sensor described above is stored in the controller A1. The controller A1 issues commands for putting and evacuating members contacting with the lower roller 16 away from the lower roller 16.

What is claimed is:

1. An image forming apparatus comprising:

a moisture feeding unit which supplies moisture to a sheet when the sheet passes through a nip portion of a pair of porous rollers, which has a lower roller absorbing water and an upper roller absorbing water in contact with the lower roller, after the sheet onto which a toner image has been formed by an image forming unit passes through a fixing unit, and comprises a water supplying unit which supplies water to the pair of porous rollers, wherein when a sheet jam occurs, a contact of a contact member in contact with each of a circumference surface of the upper roller and the lower roller, a contact of a water supplying roller which supplies water to the lower roller, and a contact of a regulation member which regulates a water content of the lower roller by coming into contact with the lower roller, are released.

2. The image forming apparatus of claim 1, further comprising a sheet detector provided downstream of the nip portion in a sheet conveyance direction, which detects a passage of the sheet.

3. The image forming apparatus of claim 1, further comprising a sheet detector which detects a passage of the sheet and a controller, which controls a sheet conveyance sequence according to a detected result of the sheet detector so as to switch between a mode in which the upper roller and the lower roller are forcibly rotated to eject a jammed sheet and a mode in which the upper roller, the regulation member and the water supplying roller being in contact with the lower roller, are separated and evacuated from the lower roller.

4. A moisture feeding unit comprising:

(a) a pair of porous rollers having a lower roller and an upper roller in contact with the lower roller, which absorb water; and (b) a water supplying unit which supplies water to the pair of porous rollers to supply moisture to a sheet through a nip portion of the pair of porous rollers, wherein when a sheet jam occurs, a contact of a contact member in contact with a circumference surface of the upper roller and the lower roller, a contact of a water supplying roller which supplies water to the lower roller by coming into contact with the lower roller, and a contact of a regulation member which regulates a water content of the lower roller by coming into contact with the lower roller, are released.

* * * * *